United States Patent [19]

Yates

[11] 4,056,241

[45] Nov. 1, 1977

[54] HOSE ROLLING DEVICE

[76] Inventor: Patrick D. Yates, 23668 Ave. 17, Madera, Calif. 93637

[21] Appl. No.: 676,735

[22] Filed: Apr. 14, 1976

[51] Int. Cl.[2] ..... B65H 75/40

[52] U.S. Cl. ..... 242/86.4

[58] Field of Search ..... 242/86, 86.3, 86.2, 242/86.4, 94

[56] References Cited

U.S. PATENT DOCUMENTS

| | | | |
|---|---|---|---|
| 1,545,546 | 7/1925 | Brittin | 242/86.3 |
| 2,685,419 | 8/1954 | Helberg | 242/86.4 |
| 3,827,097 | 8/1974 | Hamann | 242/86 |

*Primary Examiner*—Edward J. McCarthy
*Attorney, Agent, or Firm*—Vergil L. Gerard

[57] ABSTRACT

Disclosed is a device for rolling up collapsible fire hose. It has a rotatably mounted drum with one open face and a slot in the periphery. The drum is mounted on the lower end of an elongated handle. The handle has hand grips on its upper end so a user can roll the drum along a flat surface by holding the handle. The coupling on one end of a fire hose is inserted in the drum through the open drum face with the adjacent portion of the hose flattened and inserted in the peripheral slot. The hose is spread out on a ground surface and the drum is then pushed along the path of the hose, so the hose is flattened and rolled around the drum periphery.

7 Claims, 6 Drawing Figures

HOSE ROLLING DEVICE

BACKGROUND OF INVENTION

This invention relates generally to devices for rolling up hose and more particularly to devices for rolling lengths of collapsible fire hose into coils for transportation or storage. According to prevailing practice, firemen must coil hoses which have been spread out at the scene of the fire by hand. The coiling operation includes raising one end of the disconnected hose to eliminate trapped water, flattening the hose to push out further water, and starting with a coupling appliance at one end of the hose, rolling the hose into a coil. Since the hose is lying on the ground, firemen must kneel or stoop to coil the hose, flattening and straightening each round as it enters the coil to force any remaining water out the free end of the hose. After the hose is coiled and returned to the firehouse, it is frequently necessary to uncoil the hose again to clean its exterior and dry its interior. Then it must be laid out on a flat surface and coiled up again, by hand.

A need, therefore, exists for a simple device to eliminate the kneeling and stooping involved in this chore.

It is, therefore, a major object of my invention to provide a portable hose roller which is capable of coiling hose lying extended on a ground surface without the user being required to bend or stoop during the coiling.

It is another important object of my invention to provide a portable hose roller which is capable of rolling sections of hose and maintaining them on the roller for storage;

It is a further object of my invention to provide a portable hose roller of the type described which is inexpensive to manufacture and simple to use;

It is still another object of my invention to provide a portable hose roller of the type described which can be either stored with hose attached or from which the coiled hose can be easily detached without uncoiling.

These and other objects and advantages of my invention will become more readily apparent from the following detailed description of a preferred embodiment and the accompanying drawings in which.

Figure 1:
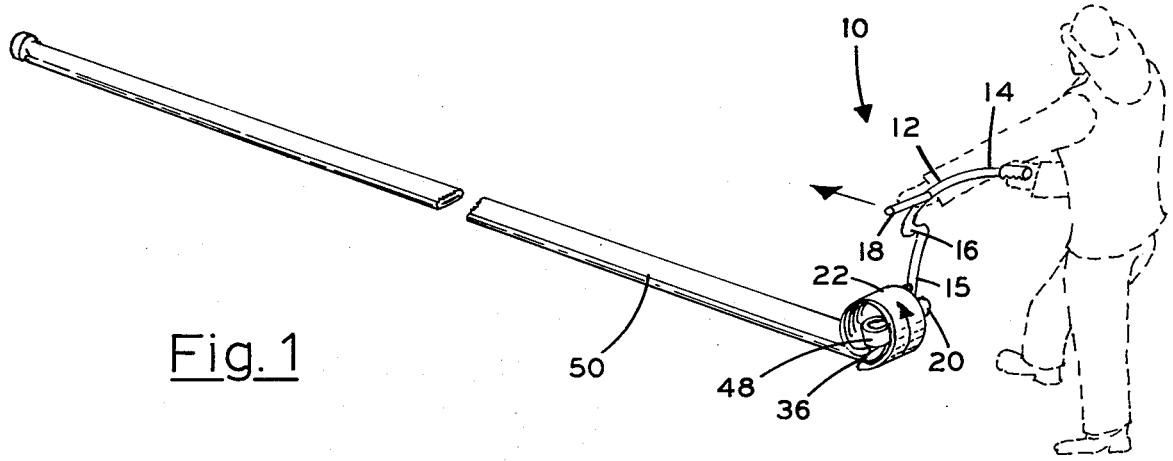
FIG. 1 is a perspective view of a preferred embodiment of my portable hose roller shown in use coiling up a flattened fire hose from a ground surface.

Referring now to the drawings, the numeral 10 designates generally my portable hose roller. The portable hose roller 10 has a handle 12 with a distal or upper end 14 and a proximal or lower end 15, and an offset 16 in between. A guidance handle 18 extends laterally from the shank of the handle near the distal end 14. At its proximal end 15, the handle 12 has an axle 20 extending laterally with respect to the axis of the handle 12.

Figure 5:
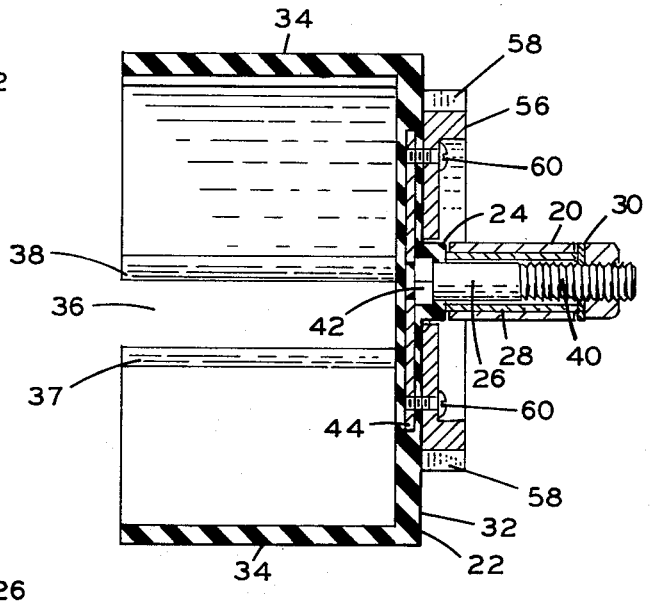
FIG. 5 is a sectional view taken on line 5—5 in FIG. 2.

A drum 22 is rotatably mounted in axle hub 20 by means of a drum hub 24, and axle 26, a bushing 28, and a washer and wing nut 30 (see FIG. 5). The drum 22 is preferably made of a hard rubber so that is has sufficient rigidity to hold its shape but is not abrasive to a hose surface.

The drum 22 has a face flange 32 which extends radially outward from the drum hub 24, and a peripheral flange 34 which encircles the axis of the drum hub 24 to form the drum outer surface 35. The peripheral flange 34 of the drum has an axially directed slot 36 to permit access of a hose to the interior of the drum from the drum surface 35 of the peripheral flange 34. The peripheral flange 34 has thickened portions 37 and 38 immediately adjacent the slot 36 for added strength to overcome the lack of support caused by the slot. The drum surface 35 has gripping tread to provide frictional engagement with the hose surface and thereby prevent the hose from slipping on the drum.

Figure 2:
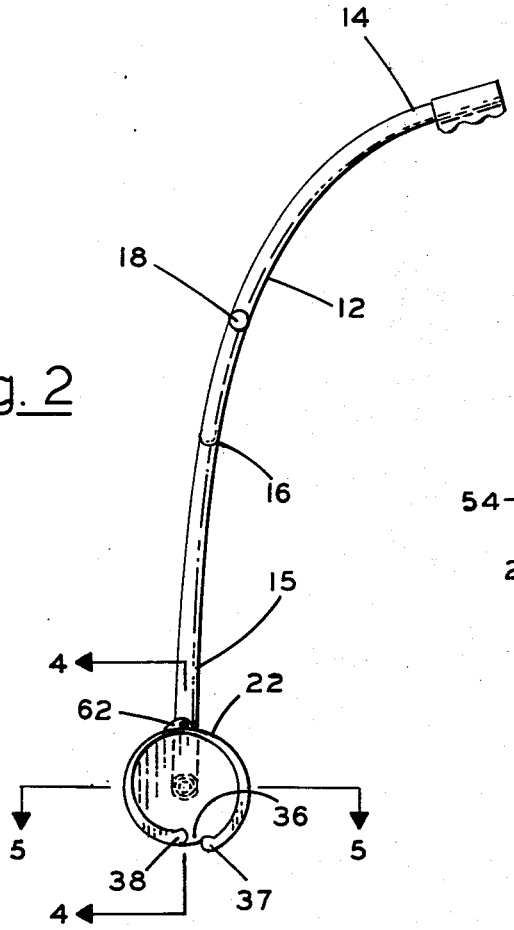
FIG. 2 is a side elevational view of a preferred embodiment of my invention shown in FIG. 1.
Figure 3:
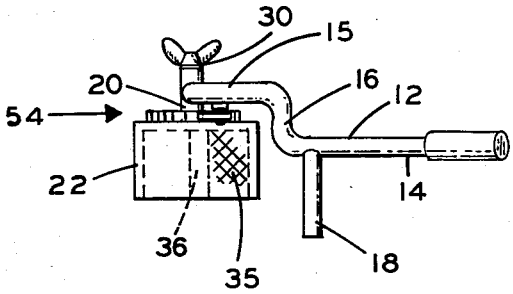
FIG. 3 is a plan view of the preferred embodiment of FIG. 1.
Figure 4:
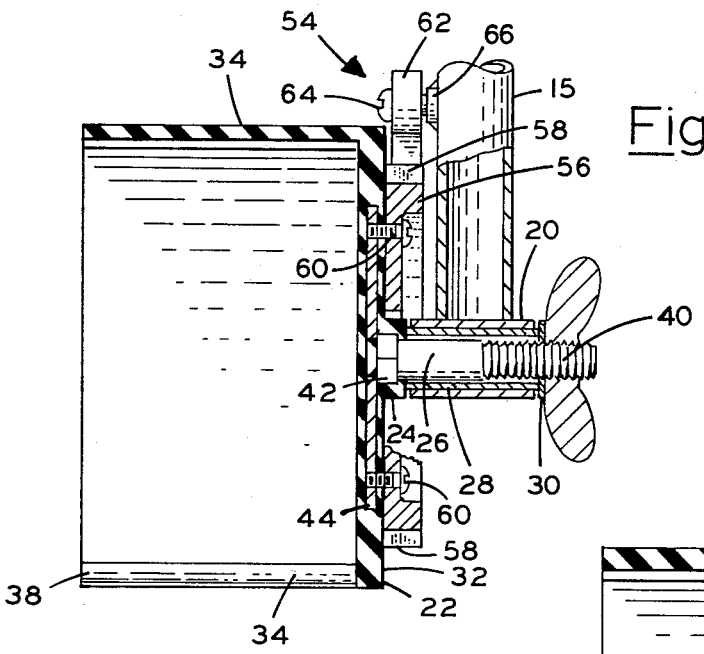
FIG. 4 is a sectional view taken on line 4—4 in FIG. 2.
Figure 6:
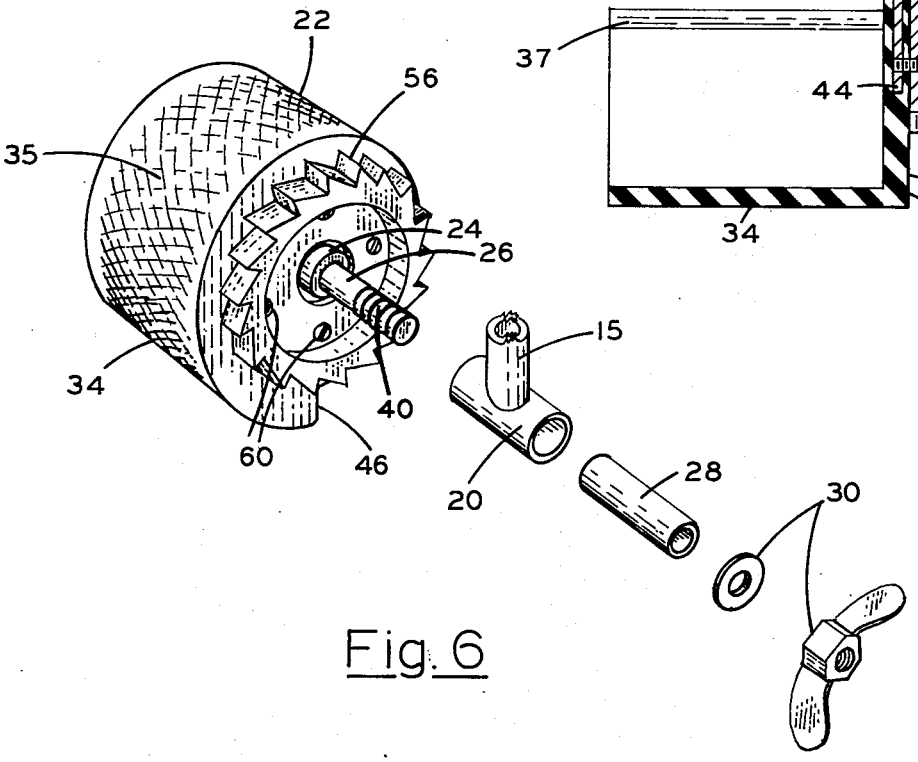
FIG. 6 is a partial perspective exploded view showing the drum removed from the handle.

The drum 22 is mounted on the proximal end 15 of the handle 12 by insertion of the axle 26 in the axle hub 20 with the bushing 28 providing a bearing for easy rotation therebetween. The end of the axle 26 has threads 40 which receive the securing wing nut and washer 30 to hold the drum on the axle hub. The axle 26 is formed from a bolt having a head 42 to which is welded a large washer disc 44 incorporated to face flange 32 of the drum. As best shown in FIGS. 2 and 6, an offset step 46 is provided in the drum surface 35 between the lips 37 and 38 to accommodate the first lap of hose as it extends from the inside of the drum and even up the outer surface of the hose roll.

OPERATION

To commence a rolling operation of a hose on the drum of my device, the coupling appliance end 48 of a hose 50 is inserted into the drum cavity through the open face. The collapsed hose immediately attached to the coupling end 48 is introduced sideways through the slot 36 in the peripheral flange 34 of the drum with the length of hose ready to be rolled onto the outside surface of the drum, disposed linearly on a flat surface. The operator then grasps my portable hose roller by gripping the distal end 14 with one hand and the guidance handle 18 with the other and pushes the drum down the length of hose. As the hose roller is moved along the hose length the drum rotates about its axle 26 and rolls the hose onto the outer surface 35 of the peripheral flange 34 into a coil.

To control the direction of the drum 12 and permit a tighter coil to be achieved, a sprocket gear 56 with radially projecting teeth 58 is mounted on the face flange 32 by screws 60. A pawl 62 is mounted on the proximal handle end 15 by a pivot pin 62 and is resiliently urged into contact with the sprocket gear teeth 58. The pawl 62 is so positioned that it passes over the teeth 58 when the drum 12 is rolled forward, but engages the teeth 58 when the drum 12 is drawn backward. This results in a coil tightening action when the roller 10 is moved down the hose enough to add a coil to the roll, and then drawn backwards to stretch the hose. The gripping tread on the drum surface 35 aids in this manipulation. The rachet action can be released to permit rolling of the drum back and forth to force trapped water out of the hose, by positioning the pawl out of engagement with the teeth 58.

Where desired, it is also effective to extend the hose to be rolled in a single overlapped position before rolling. In this position the hose is doubled back on itself at the center of its length and lapped over itself to place both couplings at the same end. The doubled over center portion of the hose is then inserted into the drum center through the slit 36 and the hose is rolled toward the couplings.

From this description of my invention and its operation it should be understood that my fire hose roller is fully capable of achieving the objects and providing the advantages heretofore attributed to it. Most particularly, it can be readily used to roll an extended fire hose with a minimum of bending or stooping.

Having described my invention, I claim:

1. A hose rolling device comprising:

an elongated rigid handle disposable in a generally vertical position;

hand grip means at the upper end of said handle;

a drum rotatably mounted at the lower end of said handle, said drum having means for releasably anchoring one end of a linearly disposed section of hose for rotation with said drum with the surface of said drum aligned to rotatably pass over the balance of said hose, and being rotatably movable by said handle to roll along the balance of said hose and coil the same about said surface.

2. A hose rolling device as described in claim 1, in which:

said gripping means at the upper end of said handle includes a hand grip on the distal portion of the upper end of said handle and a second hand grip mounted near the upper end of said handle but spaced below said first hand grip a distance sufficient to provide a suitable crank arm in the upper portion of said handle to permit a user with one hand on each grip to apply leverage to said handle in both a vertical and substantially horizontal plane.

3. A hose rolling device comprising:

a roller having a substantially cylindrical outer surface disposed to roll along a linearly extended length of hose and coil said hose thereon, and releasable anchor means disposed to engage an end portion of said hose and rotate said end portion with said roller; and handle means rotatably mounting said roller and manually operable to roll said roller along a generally horizontal surface, said handle means including a mounting shaft rotatably mounting said roller, and one way clutch means disposed to prevent rotation of said roller about said shaft in one direction and permit rotation in the opposite direction.

4. A hose rolling device as described in claim 3 in which:

said roller is a drum having one open face and one closed face with an axle mounted centrally in said closed face and projecting laterally therefrom outwardly with respect to said drum, and said roller has a slot in its periphery which is open at the open face of said drum and has a size and shape sufficient to snugly receive a flattened portion of a fire hose;

said handle means includes a hub disposed to rotatably receive said axle; and said closed face of said drum has a ratchet gear attached thereto and rotatable therewith and said handle has a pawl mounted adjacent said hub and disposed to engage the teeth of said ratchet gear and block the rotation of said roller in a first direction and to pass over said teeth on said ratchet gear and permit rotation of said roller in the opposite direction.

5. A hose rolling device as described in claim 1 in which:

said drum has means defining a frictional surface on the periphery thereof disposed to engage the surface of the first wrap of hose rolled thereon and resist lateral movement of said hose wrap with respect to said drum.

6. A hose rolling device as described in claim 3 in which:

said roller has a plurality of grooves and lands in the periphery thereof disposed to engage the inner surface of the first wrap of hose rolled thereon and resist movement of said hose wrap with respect to said roller.

7. A hose rolling device as described in claim 3 in which:

said handle means includes an elongated rigid handle disposable in a generally upstanding position and having hand grip means at the upper end thereof;

said hand grip means including a first hand grip on the distal portion of the upper end of said handle and a second hand grip mounted near the upper end of said handle but spaced below said first hand grip a distance sufficient to provide a suitable crank arm in the upper portion of said handle to permit a user with one hand on each grip to apply leverage to said handle in both a vertical and a generally horizontal plane.

* * * * *